US010583971B2

(12) United States Patent
Kruzel

(10) Patent No.: US 10,583,971 B2
(45) Date of Patent: Mar. 10, 2020

(54) TIE AND LEVER TENSIONER BUCKLE

(71) Applicant: Panduit Corp., Tinley Park, IL (US)

(72) Inventor: Mateusz Kruzel, Orland Park, IL (US)

(73) Assignee: Panduit Corp., Tinley Park, IL (US)

( * ) Notice: Subject to any disclaimer, the term of this patent is extended or adjusted under 35 U.S.C. 154(b) by 65 days.

(21) Appl. No.: 15/927,219

(22) Filed: Mar. 21, 2018

(65) Prior Publication Data

US 2018/0273263 A1 Sep. 27, 2018

Related U.S. Application Data

(60) Provisional application No. 62/475,923, filed on Mar. 24, 2017.

(51) Int. Cl.

| | |
|---|---|
| ***B65D 63/08*** | (2006.01) |
| ***A44B 11/12*** | (2006.01) |
| ***A44B 11/14*** | (2006.01) |

(52) U.S. Cl.

CPC ..... *B65D 63/08* (2013.01); *A44B 11/12* (2013.01); *A44B 11/125* (2013.01); *A44B 11/14* (2013.01); *A44D 2211/00* (2013.01)

(58) Field of Classification Search

CPC ..... A44B 11/125; A44B 11/12; A44B 11/14; B65D 63/08; Y10T 24/4016; Y10T 24/4072

See application file for complete search history.

(56) References Cited

U.S. PATENT DOCUMENTS

| | | | | |
|---|---|---|---|---|
| 1,324,927 | A | 12/1919 | Robinson | |
| 2,654,926 | A | 10/1953 | Delafosse | |
| 2,663,923 | A | 12/1953 | Mattingly | |
| 2,816,337 | A | 12/1957 | Gerrard et al. | |
| 3,222,745 | A | 12/1965 | Palmleaf et al. | |
| 3,276,089 | A | 10/1966 | Cheever et al. | |
| 3,423,804 | A | 1/1969 | Hatfield | |
| 3,797,077 | A | 3/1974 | Omori et al. | |
| 3,805,334 | A | 4/1974 | Graup | |
| 4,281,440 | A | 8/1981 | Britz | |
| 7,171,729 | B2 | 2/2007 | Bulanda et al. | |
| 7,392,570 | B2 | 7/2008 | Bulanda et al. | |
| 8,793,841 | B2 | 8/2014 | DeBerry et al. | |
| 9,145,244 | B2 * | 9/2015 | Nakajima | F16B 2/08 |

(Continued)

FOREIGN PATENT DOCUMENTS

| | | |
|---|---|---|
| DE | 2007232 A1 | 9/1971 |
| EP | 1676494 A1 | 7/2006 |
| GB | 220586 | 8/1924 |

(Continued)

*Primary Examiner* — Robert Sandy

(74) *Attorney, Agent, or Firm* — Christopher S. Clancy; James H. Williams; Aimee E. McVady

(57) ABSTRACT

A buckle used to fasten opposing ends of an object encircling strap around a bundle. The buckle includes a base and a lever tensioner. The base has a bottom and two opposing sides extending from the bottom. Each side includes a first end and a second end. The sides at the first end of the base have pivot holes. The lever tensioner is pivotally connected to the base. The lever tensioner includes a first end and a second end. The first end of the lever tensioner includes pivot hinge tabs. The pivot hinge tabs are positioned in the pivot holes of the base to pivotally secure the lever tensioner to the base.

10 Claims, 17 Drawing Sheets

(56) References Cited

U.S. PATENT DOCUMENTS

| | | | |
|---|---|---|---|
| 2011/0016673 | A1 | 1/2011 | Leist |
| 2011/0099846 | A1 | 5/2011 | Fischer |

FOREIGN PATENT DOCUMENTS

| | | | |
|---|---|---|---|
| JP | 5734892 | B2 | 2/2012 |
| JP | 2013139849 | A | 7/2013 |
| JP | 2013167324 | A | 8/2013 |
| JP | 5696057 | B2 | 4/2015 |
| JP | 2016196916 | A | 11/2016 |
| JP | 2016196917 | A | 11/2016 |

* cited by examiner

TIE AND LEVER TENSIONER BUCKLE

CROSS REFERENCE TO RELATED APPLICATIONS

This application claims priority to U.S. Provisional Application Ser. No. 62/475,923, filed Mar. 24, 2017, the subject matter of which is hereby incorporated by reference in its entirety.

FIELD OF THE INVENTION

The present invention relates to a stainless steel tie and buckle, and more particularly to a stainless steel tie with a tool-less lever tensioner buckle.

BACKGROUND OF THE INVENTION

Ties or straps are used to retain and secure a bundle of objects to a mounting surface, such as a pole. A buckle is often used with the tie or strap. The buckles typically are comprised of separate components that are used to lock a tie and maintaining tension on the tie. A specialized tool is required to complete the tensioning, locking, and cut-off of the tie or strap.

It is desirable to provide a buckle that does not require multiple components or specialized tools to function properly. It is also desirable to provide a buckle that can tension and secure the tie or strap to a mounting surface without a tool or with only a common hand-tool.

SUMMARY OF THE INVENTION

A buckle that fastens opposing ends of an object encircling strap. The buckle includes a base with a bottom and two opposing sides extending from the bottom. Each side of the buckle includes a first end and a second end. The first end of each side of the base includes pivot holes. The buckle also includes a lever tensioner pivotally connected to the base. The lever tensioner includes a first end and a second end. The first end of the lever tensioner includes lever pivot hinge tabs positioned in the pivot holes of the base to pivotally secure the lever tensioner to the base.

DETAILED DESCRIPTION

Figure 1:
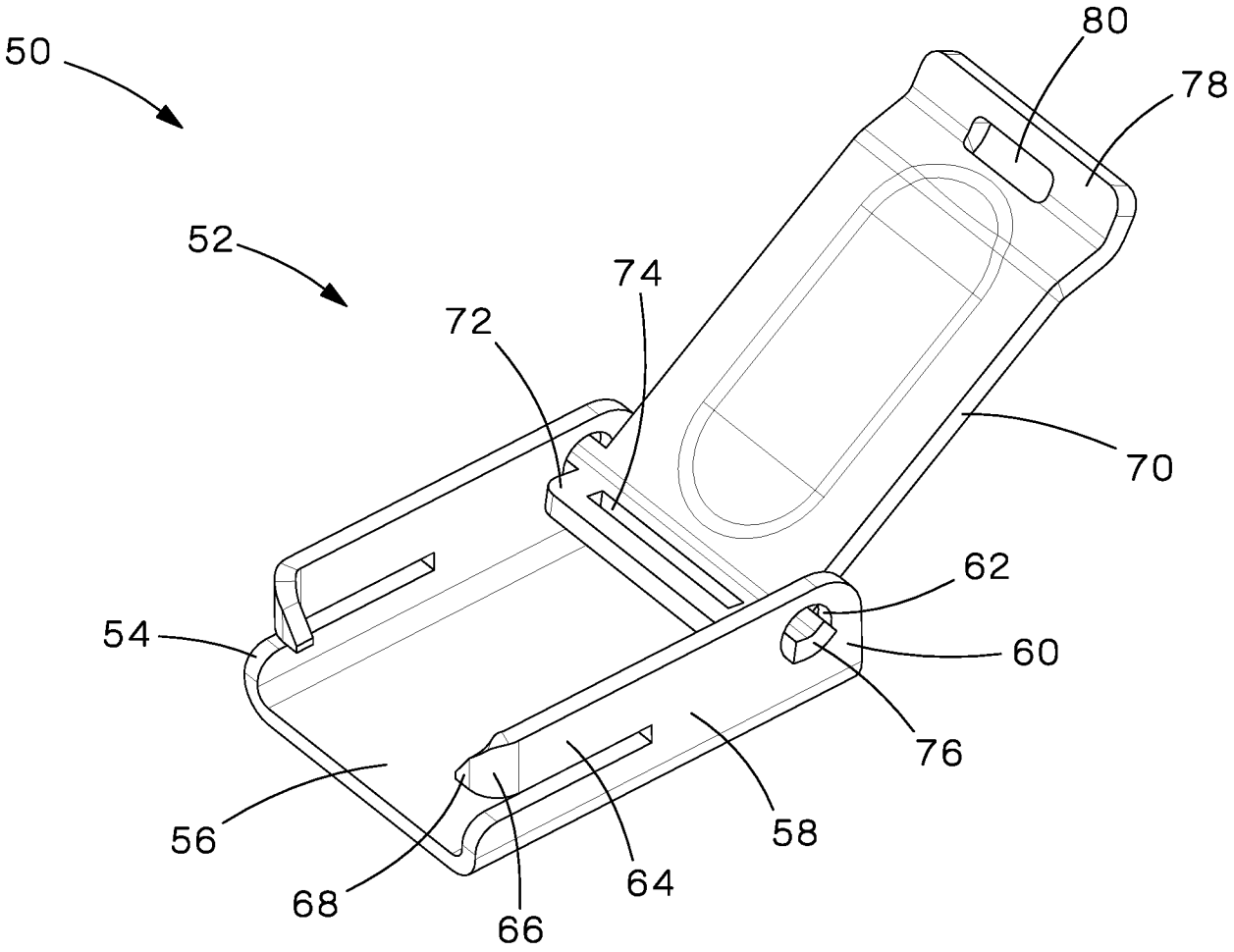
FIG. 1 is a perspective view of a lever tensioner buckle of the present invention.

FIGS. 1-8B illustrate a first embodiment 50 of the lever tensioner buckle 52 and tie or strap 100. FIG. 1 illustrates an opened lever tensioner buckle 52. The lever tensioner buckle 52 includes a buckle base 54 and a lever tensioner 70. The buckle base 54 includes a bottom 56 with two opposing sides 58. Each side 58 extends from the bottom 56. Each side 58 includes a first end 60 with pivot holes 62 and a second end 64 with lever tensioner retaining hooks 66. The lever tensioner retaining hooks 66 include inwardly extending tips 68.

The lever tensioner 70 includes a first end 72 with an elongated slot 74 for receiving the tie 100. The first end 72 of the lever tensioner 70 also includes lever pivot hinge tabs 76. The lever pivot hinge tabs 76 are installed in the pivot holes 62 of the base 54 to pivotally secure the lever tensioner 70 to the base 54. The second end 78 of the lever tensioner 70 includes a pry bar slot 80 for receiving a common hand tool (not illustrated), such as a screwdriver, if necessary.

The lever tensioner 70 is slotted and bent at the pivot point to allow threading of the tie 100 at the first end 72 of the lever tensioner 70 when the buckle 52 is fully open. The bend location increases the stiffness of the hinge tabs 76 acting as the pivot axles. Prior art buckles generally require the tie to be threaded back thru the buckle. This process is complicated and limits the size and material of the ties that can be used. In contrast, the single pass threading of the lever tensioner buckle 52 receives a heavy duty stainless steel tie or strap or a light weight tie or strap.

Figure 2:
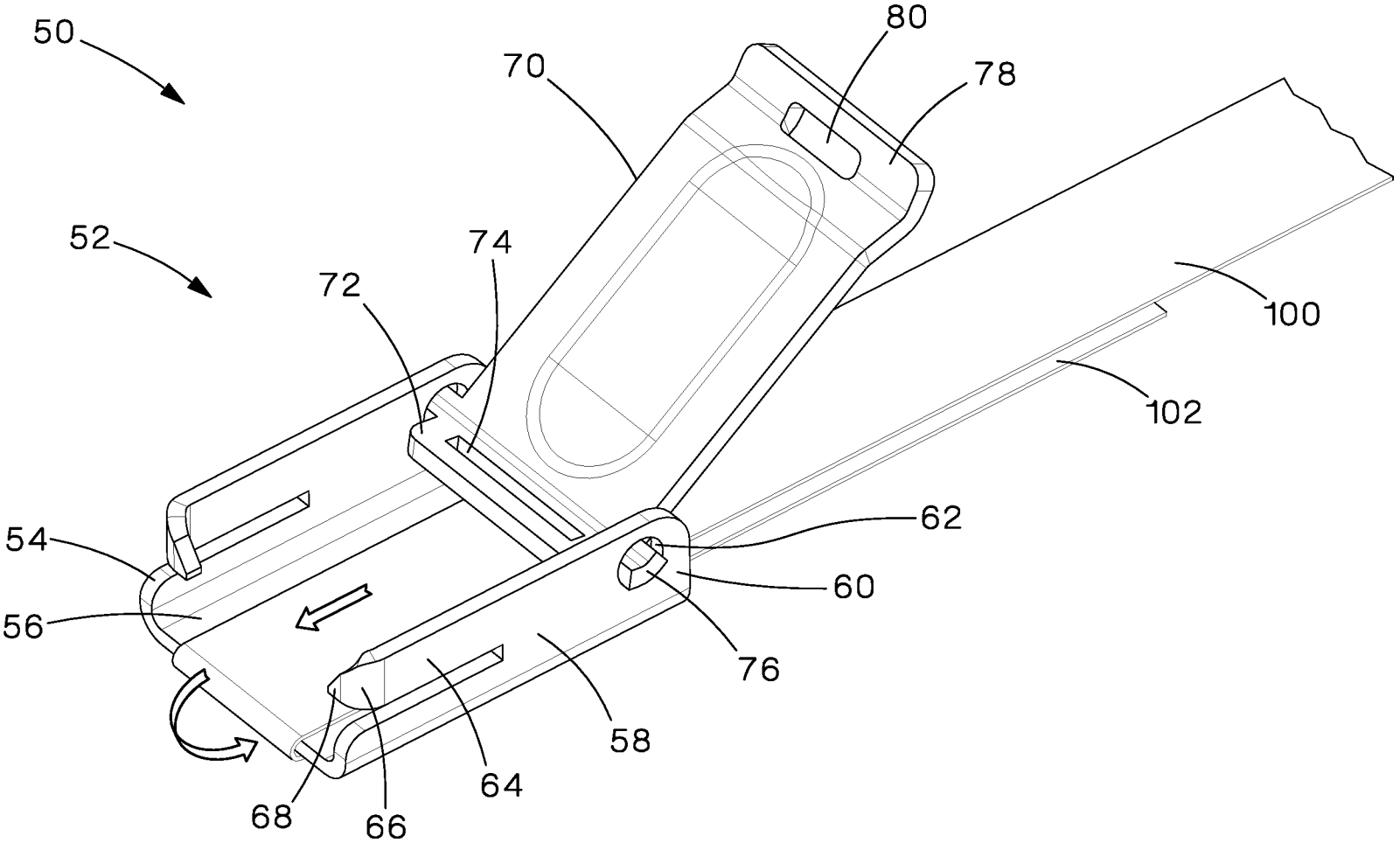
FIG. 2 is a perspective view of the lever tensioner buckle of FIG. 1 with a first end of a tie wrapped around the buckle.
Figure 3:
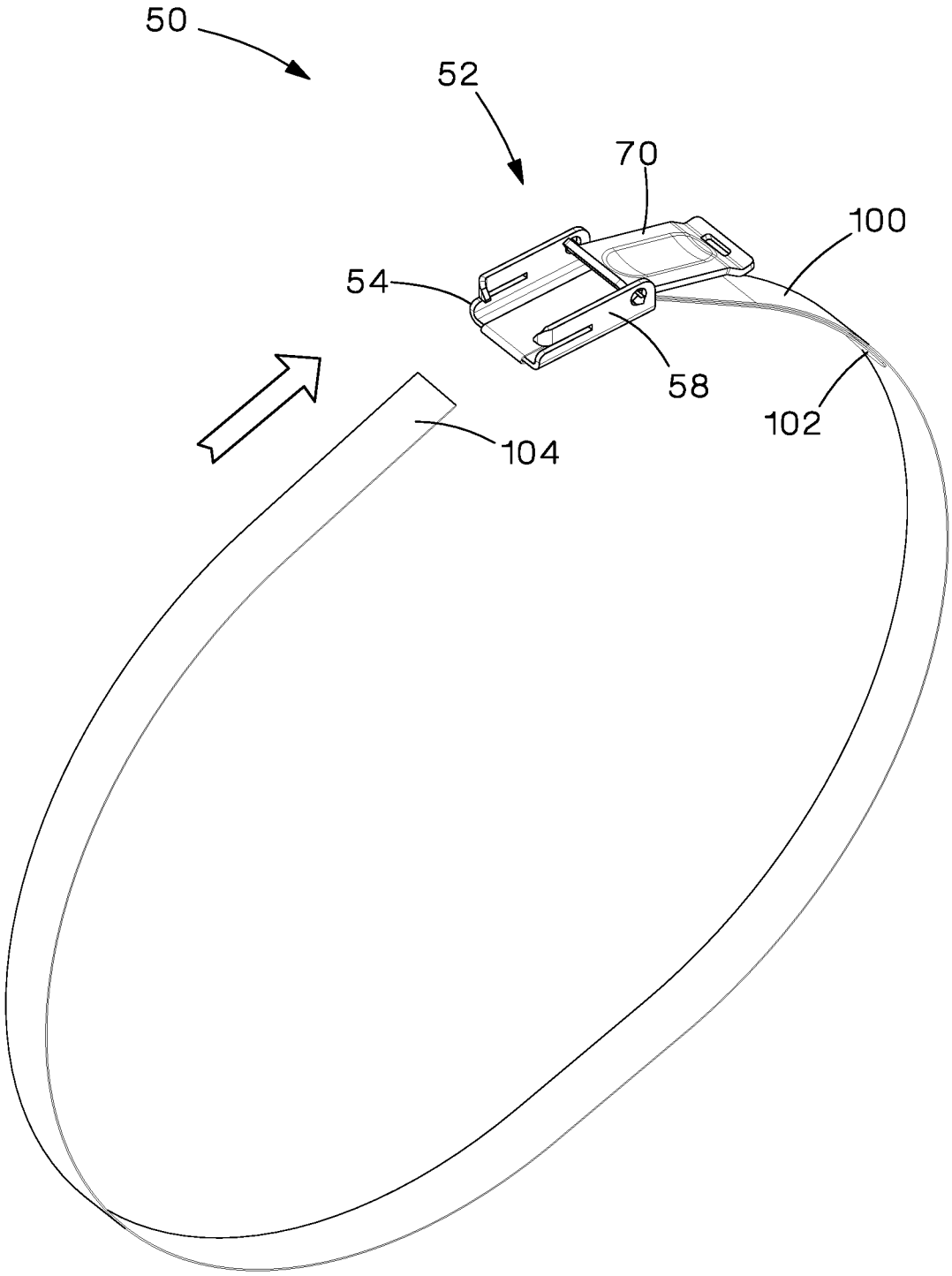
FIG. 3 is a perspective view of the lever tensioner buckle and tie of FIG. 2 with the second end of the tie positioned to be inserted in the buckle.
Figure 4:
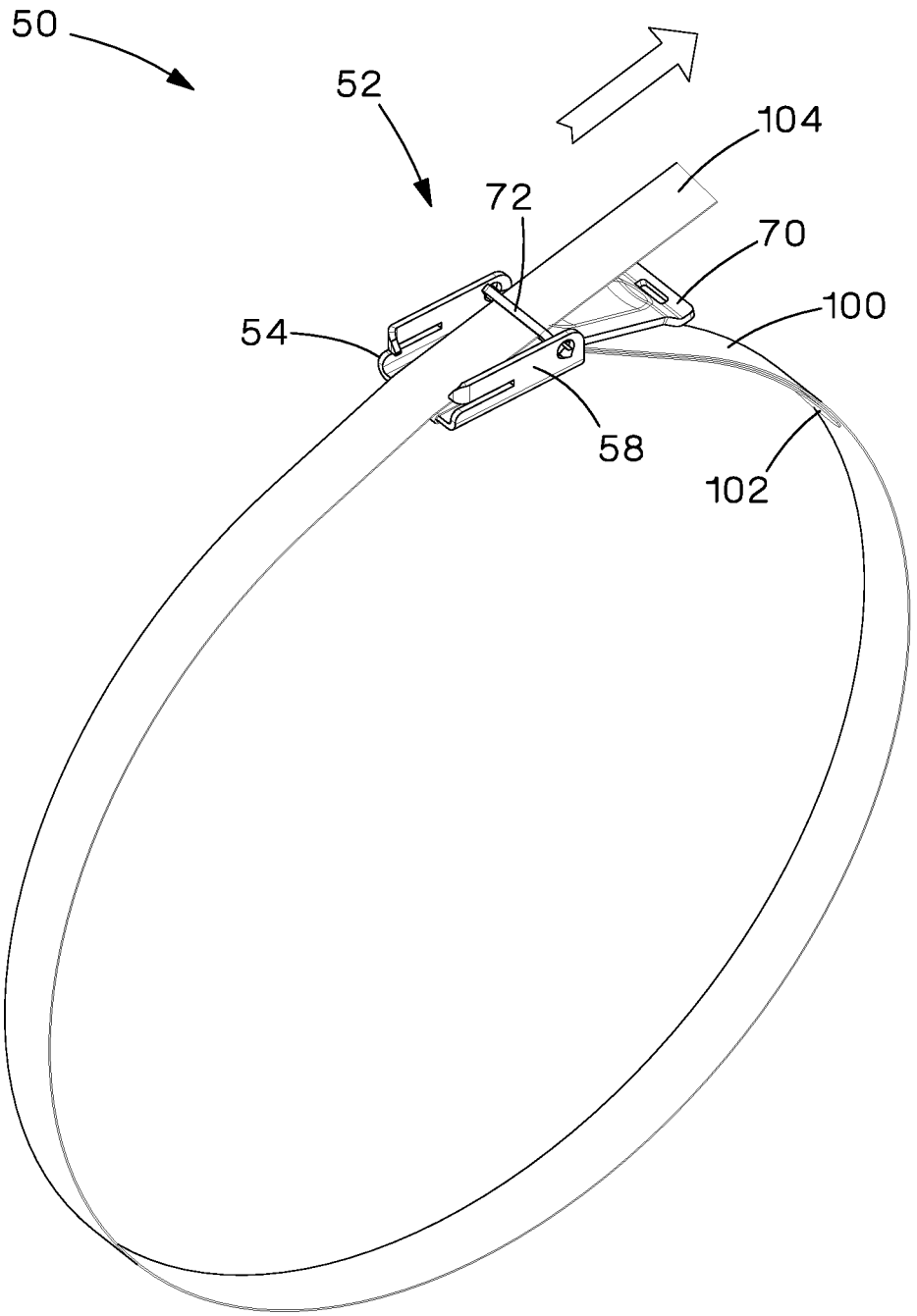
FIG. 4 is a perspective view of the lever tensioner buckle and tie of FIG. 3 with the second end of the tie threaded through the buckle.
Figure 5:
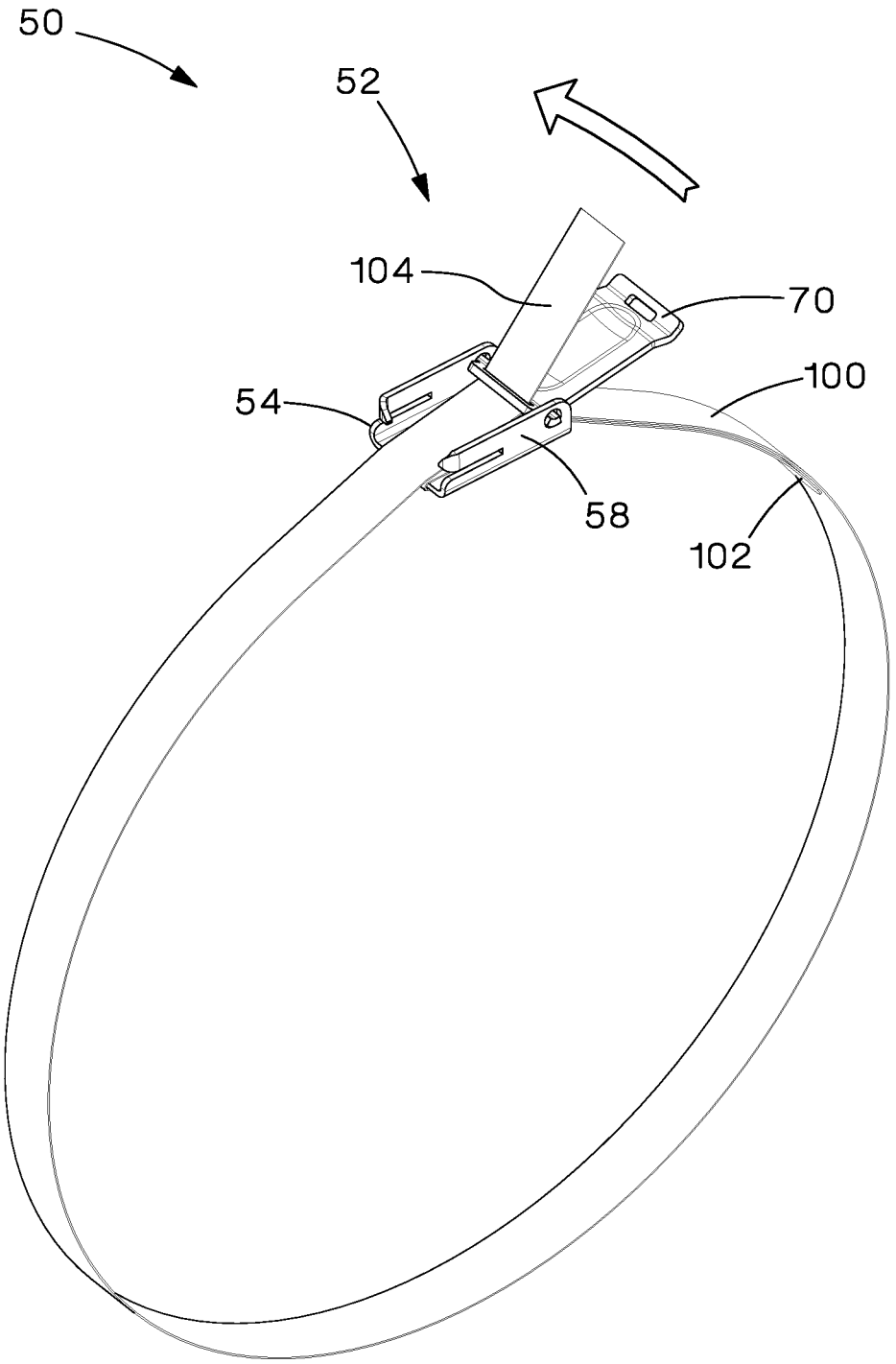
FIG. 5 is a perspective view of the lever tensioner buckle and tie of FIG. 4 with the lever tensioner rotated.
Figure 6A:
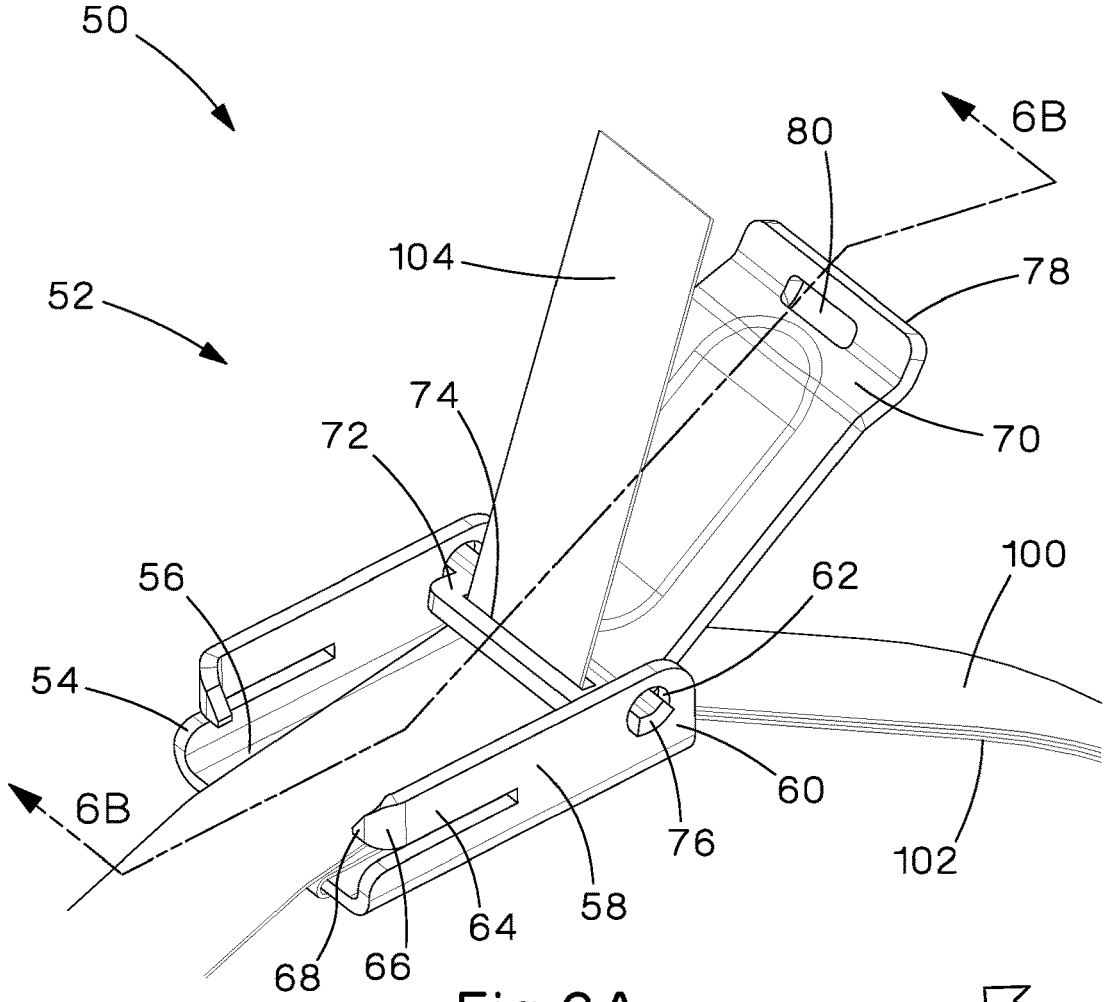
FIG. 6A is a perspective view of the lever tensioner buckle and tie of FIG. 5 with the lever tensioner rotated.
Figure 6B:
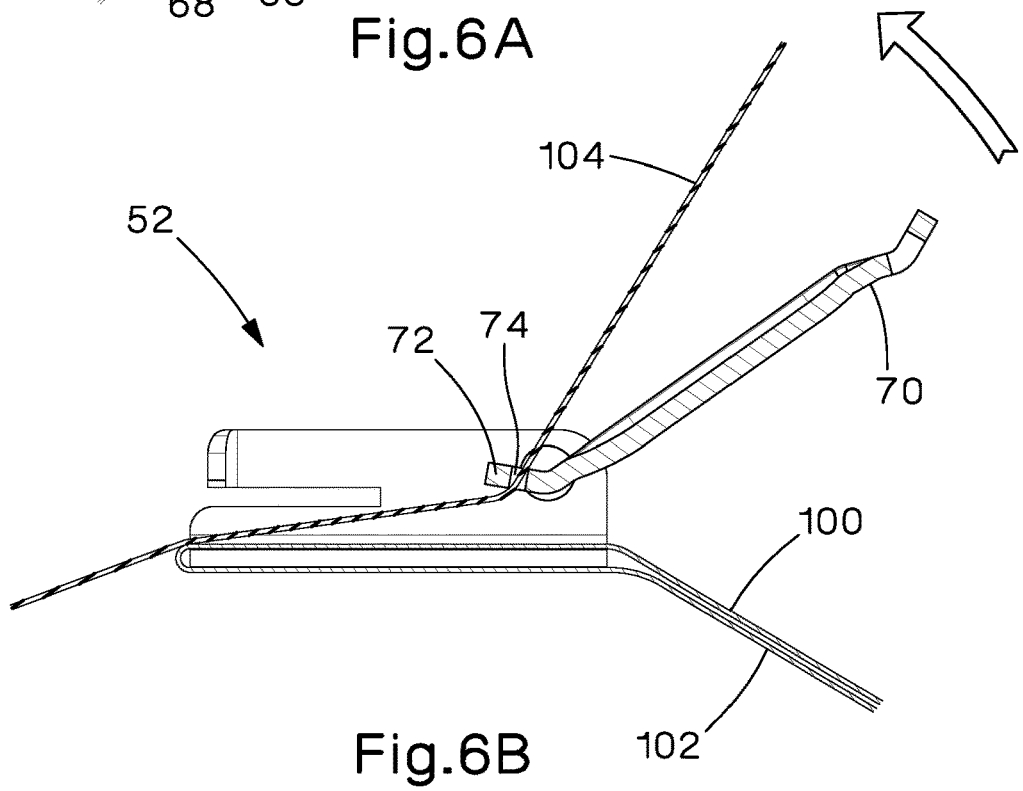
FIG. 6B is a cross-sectional view of the lever tensioner buckle and tie of FIG. 6A taken along line 6B-6B.
Figure 7A:
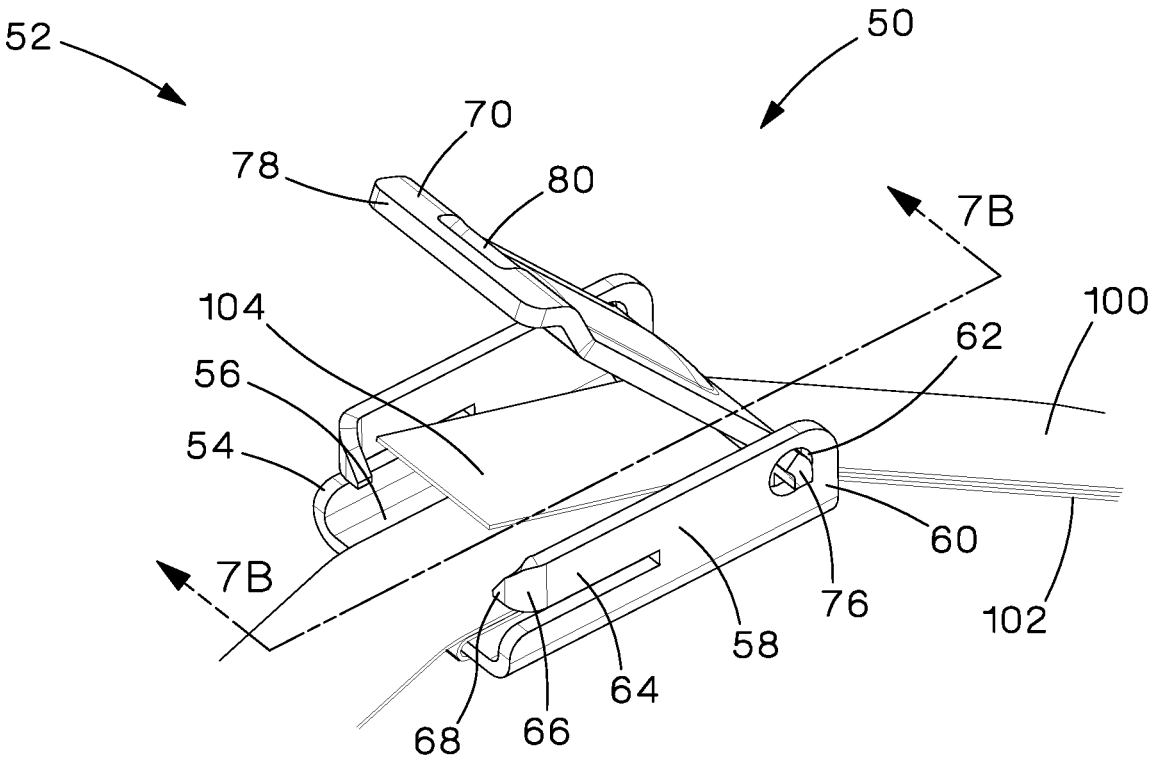
FIG. 7A is a perspective view of the lever tensioner buckle and tie of FIG. 6A with the lever tensioner rotated.
Figure 7B:
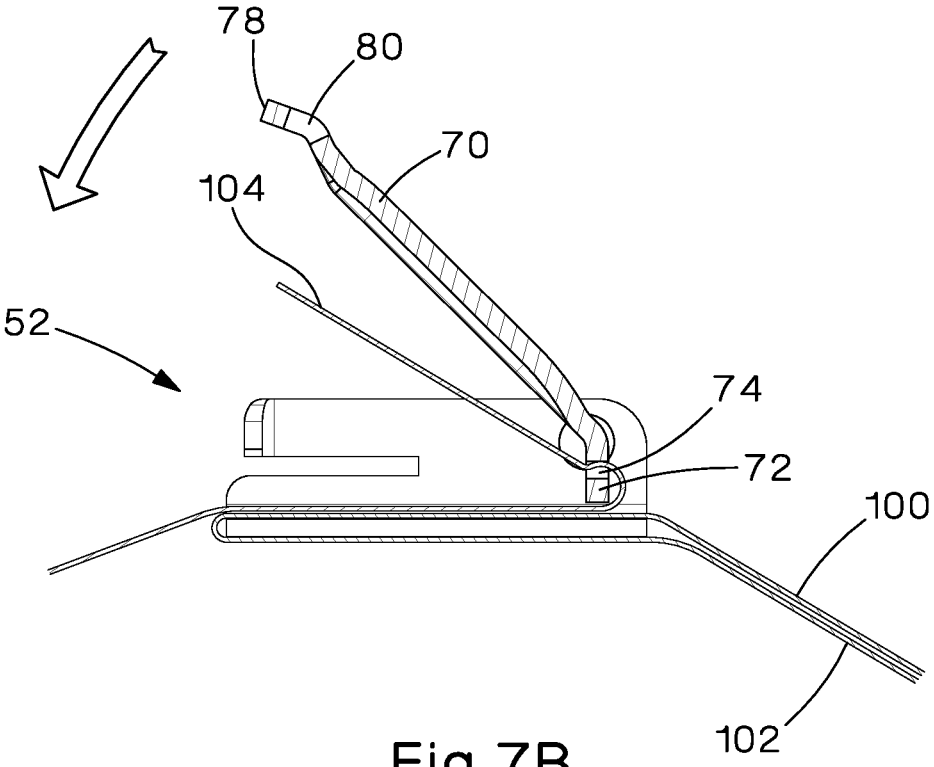
FIG. 7B is a cross-sectional view of the lever tensioner buckle and tie of FIG. 7A taken along line 7B-7B.
Figure 8A:
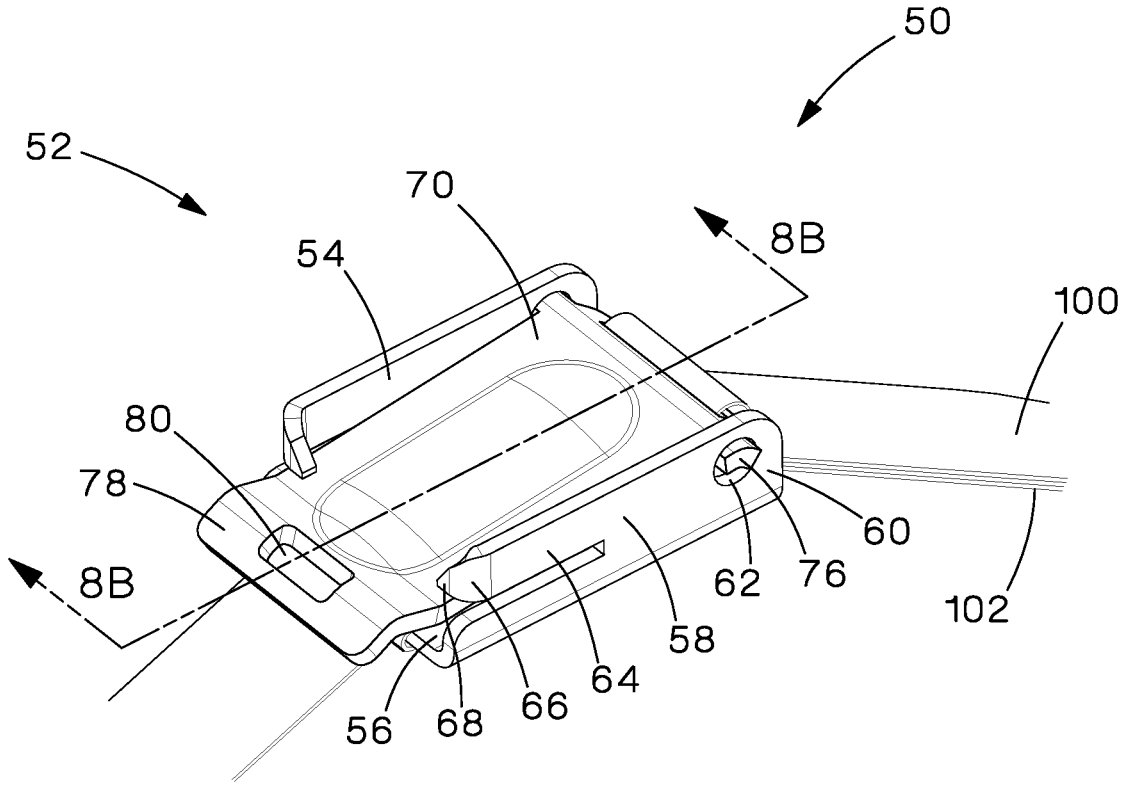
FIG. 8A is a perspective view of the lever tensioner buckle and tie of FIG. 7A with the lever tensioner rotated to the closed position.
Figure 8B:
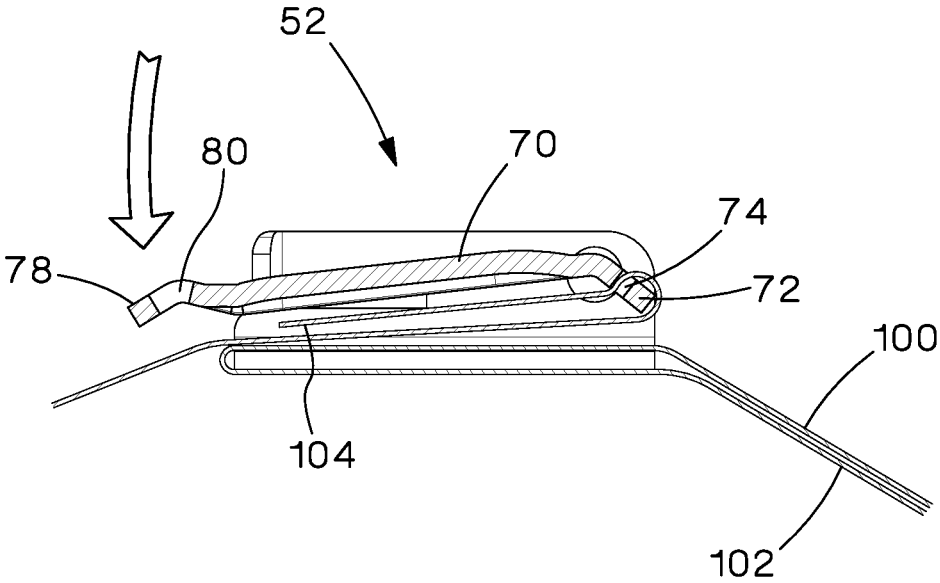
FIG. 8B is a cross-sectional view of the lever tensioner buckle and tie of FIG. 8A taken along the line 8B-8B.

As illustrated in FIG. 2, a folded first end 102 of the tie 100 wraps around the bottom 56 of the buckle base 54. The buckle base 54 and tie 100 are then positioned on a bundle. As illustrated in FIGS. 3 and 4, the tie wraps around to from a loop or circle. When the buckle is fully opened, the second end 104 of the tie 100 is thread thru the elongated slot 74 at the first end 72 of the lever tensioner 70. The tie 100 is then tensioned by hand until the tie 100 is snug on the bundle. If necessary, the second end 104 of the tie 100 is cut leaving about 1-1.5 inches of the tie 100 to extend past the elongated slot 74.

As illustrated in FIGS. 5-8, the lever tensioner buckle 52 rotates from the open position to a closed position. The elongated slot 74 in the lever tensioner 70 cams the tie 100 as the buckle 52 is closed. The buckle 52 is closed by actuating the lever tensioner 70 until it snaps under the retaining hooks 66 that are at the second end 64 of the buckle base 54. The retaining hooks 66 maintain the lever tensioner 70 in a closed position over the base 54 and the tie 100 but the lever tensioner 70 can be released, if needed, using a screw driver or pliers. Closing the buckle 52 tensions the tie 100 beyond the initial pre-tensioned amount. If desired, a hand tool (not illustrated) may be installed in the slot 80 at the second end 78 of the lever tensioner 70 to close the buckle 52.

Figure 9:
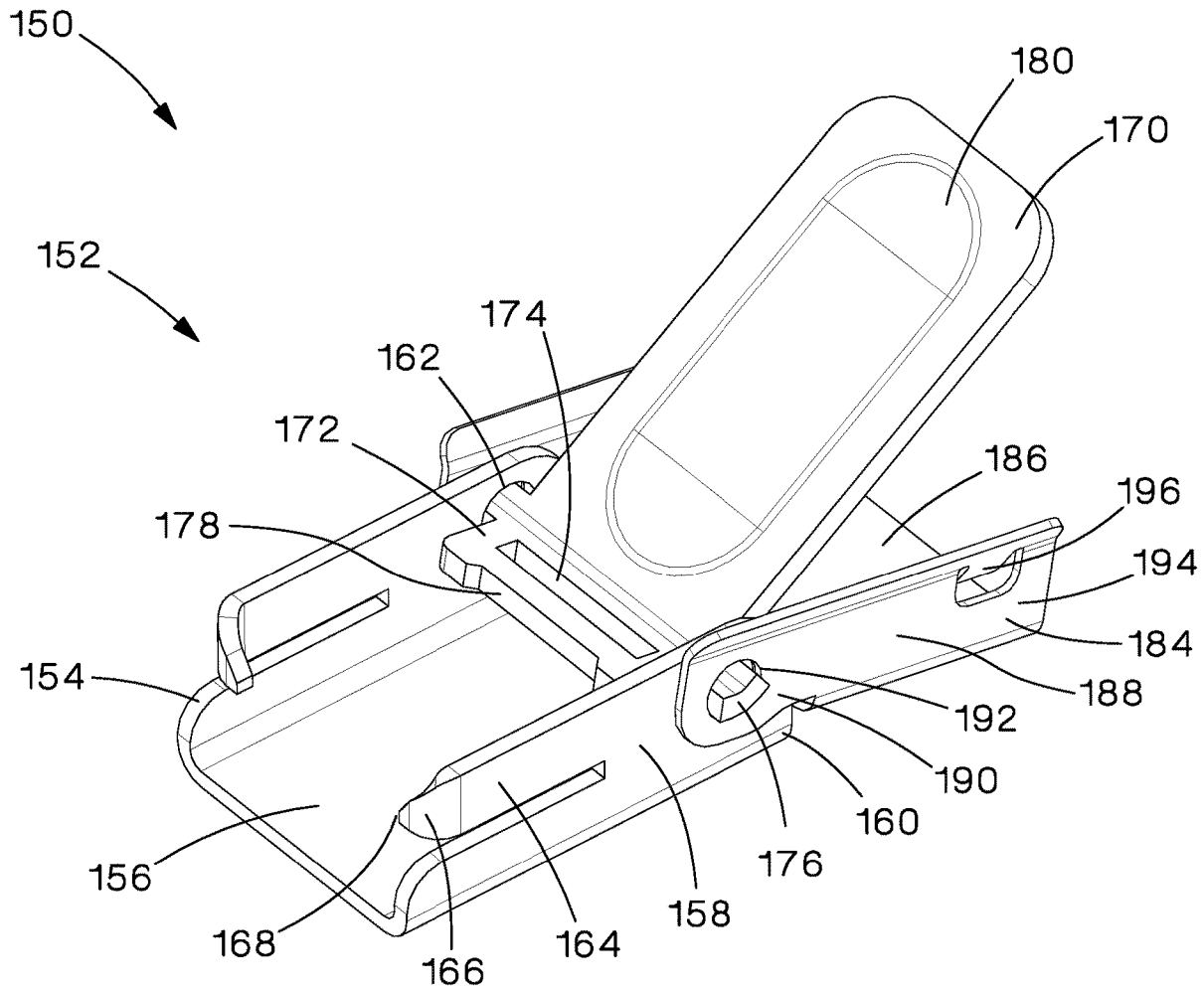
FIG. 9 is a perspective view of a second embodiment of the lever tensioner buckle of the present invention.

FIGS. 9-17B illustrate a second embodiment 150 of the lever tensioner buckle 152 and tie 200. FIG. 9 illustrates an open lever tensioner buckle 152. The lever tensioner buckle 152 includes a buckle base 154, a lever tensioner 170, and a cover 184. The base 154 includes a bottom 156 with two opposing sides 158. Each side 158 extends from the bottom 156. Each side 158 includes a first end 160 with pivot holes 162 and a second end 164 with lever tensioner retaining hooks 166. The lever tensioner retaining hooks 166 include inwardly pointed tips 168.

The lever tensioner 170 includes a first end 172 and a second end 180. The first end 172 is angled with an elongated slot 174 for receiving a tie 200. The first end 172 also includes lever pivot hinge tabs 176. The hinge tabs 176 extend through the pivot holes 162 in the base 154 to pivotally connect the lever tensioner 170 to the base 154. The first end 172 also includes an indented portion 178 with a reduced area for receiving a reduced width tie. The indented portion 178 prevents the smaller tie from sliding or shifting on the lever tensioner 170.

The cover 184 includes a top 186 with first and second opposing sides 188. Each side 188 includes a first end 190 with a pivot hole 192 and a second end 194 with latches 196. The pivot holes 192 of the cover 184 align with the pivot holes 162 of the base 154 and the lever pivot hinge tabs 176. The latches 196 extend from the sides 188 of the cover 184 inwardly towards a center of the cover 184.

Figure 10:
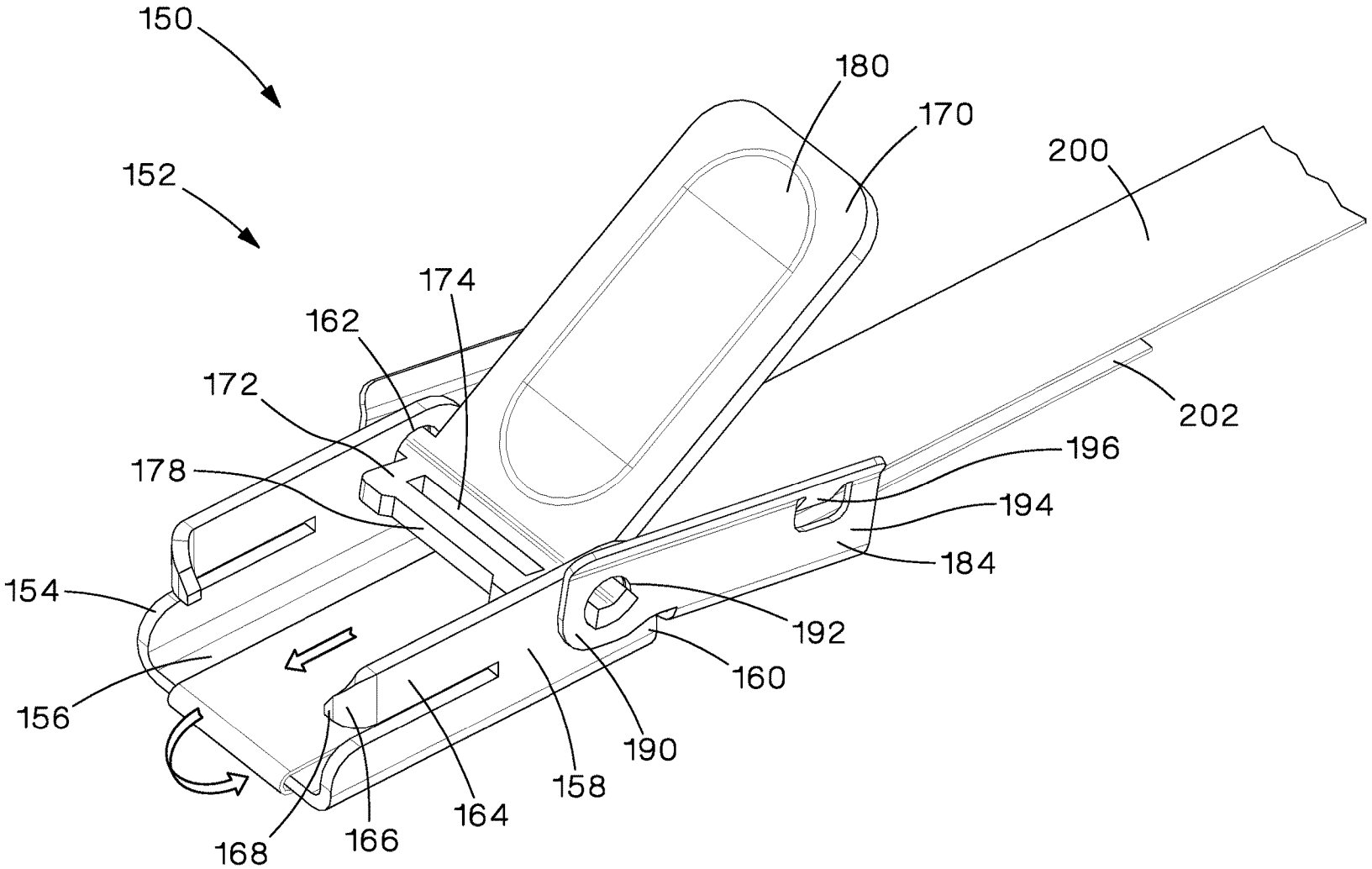
FIG. 10 is a perspective view of the lever tensioner buckle of FIG. 9 with a first end of a tie wrapped around the buckle.
Figure 11:
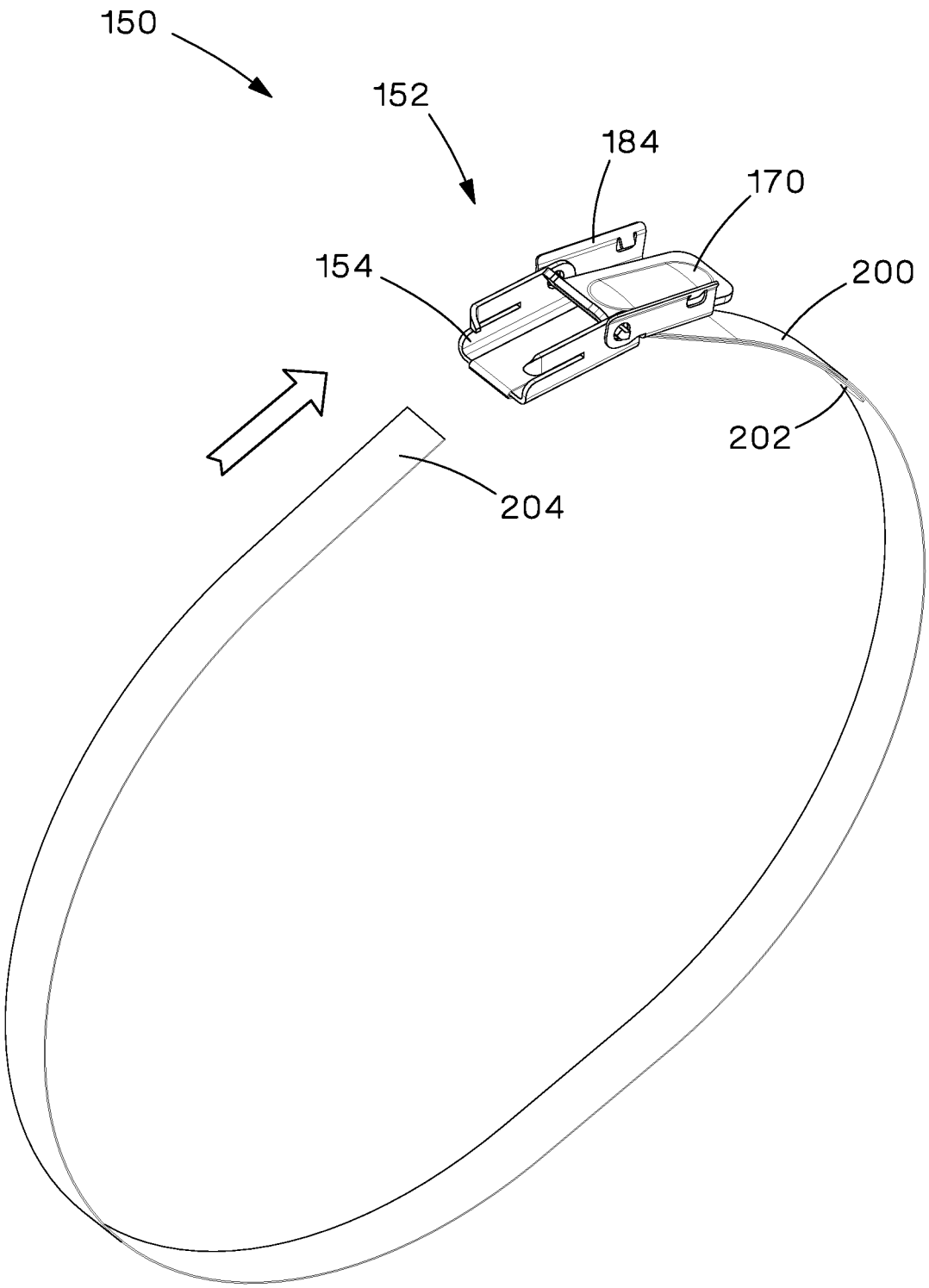
FIG. 11 is a perspective view of the lever tensioner buckle of FIG. 10 with the second end of the tie positioned to be inserted in the buckle.
Figure 12:
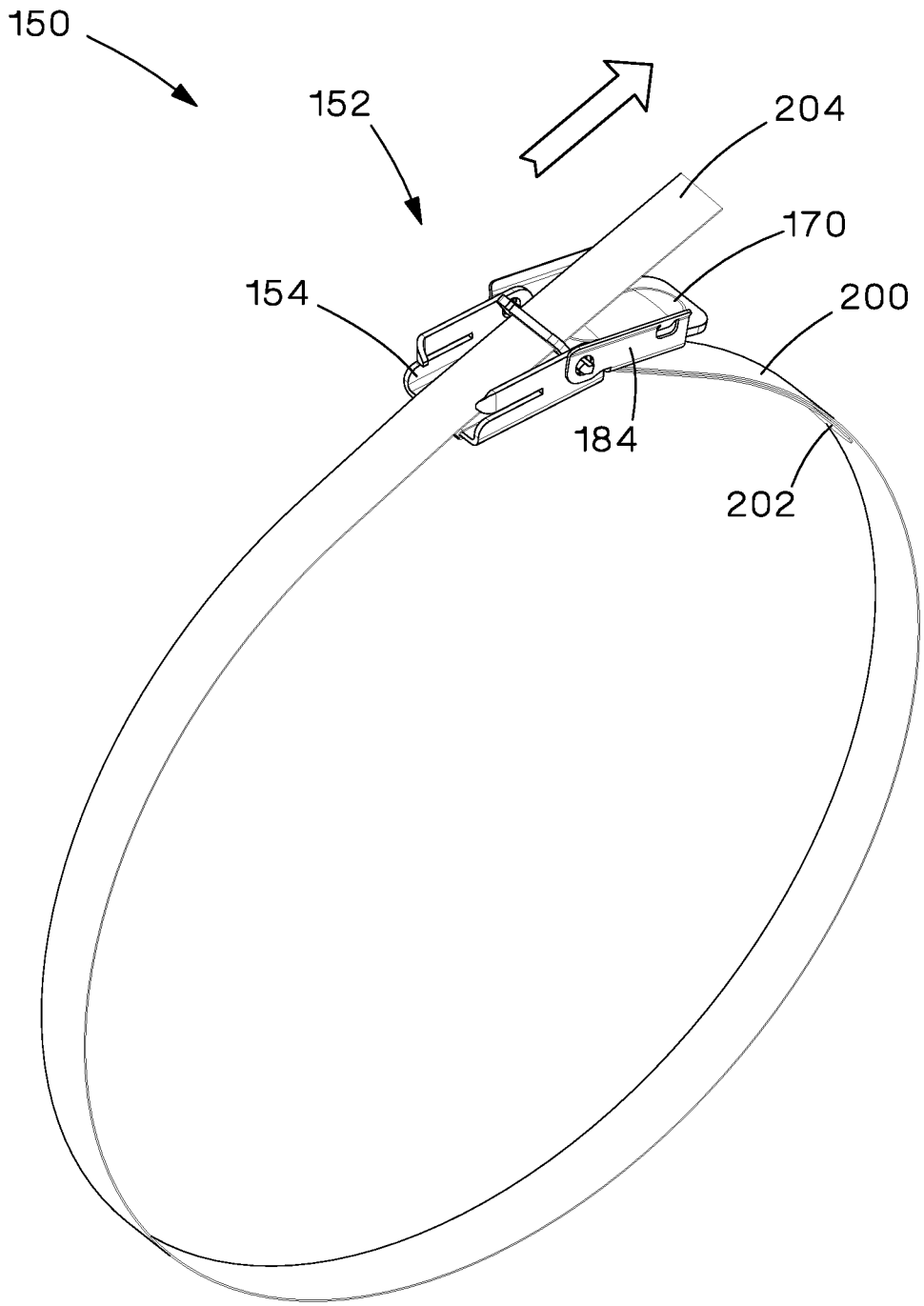
FIG. 12 is a perspective view of the lever tensioner buckle and tie of FIG. 11 with the second end of the tie threaded through the buckle.
Figure 13:
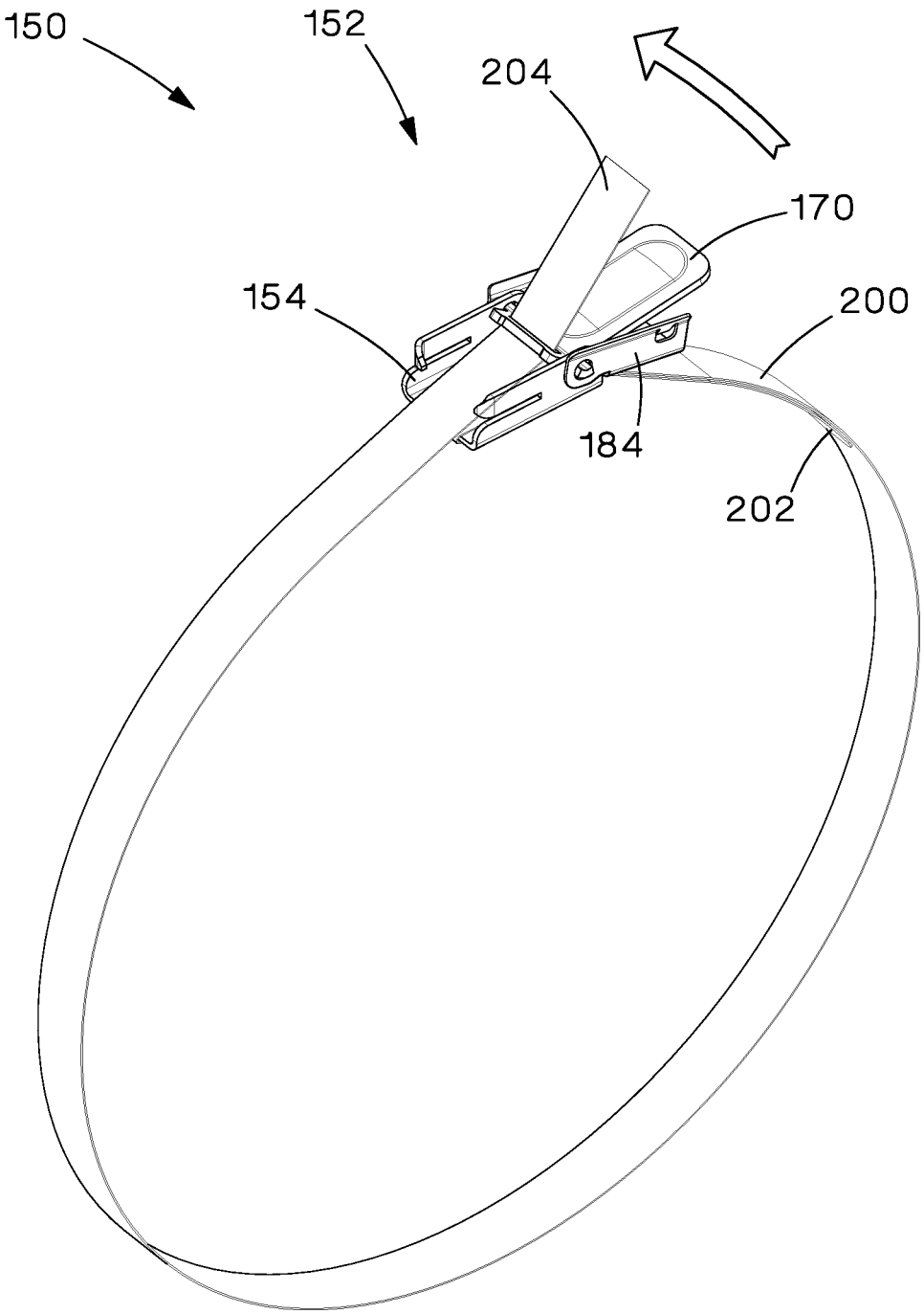
FIG. 13 is a perspective view of the lever tensioner buckle and tie of FIG. 12 with the lever tensioner rotated.
Figure 14A:
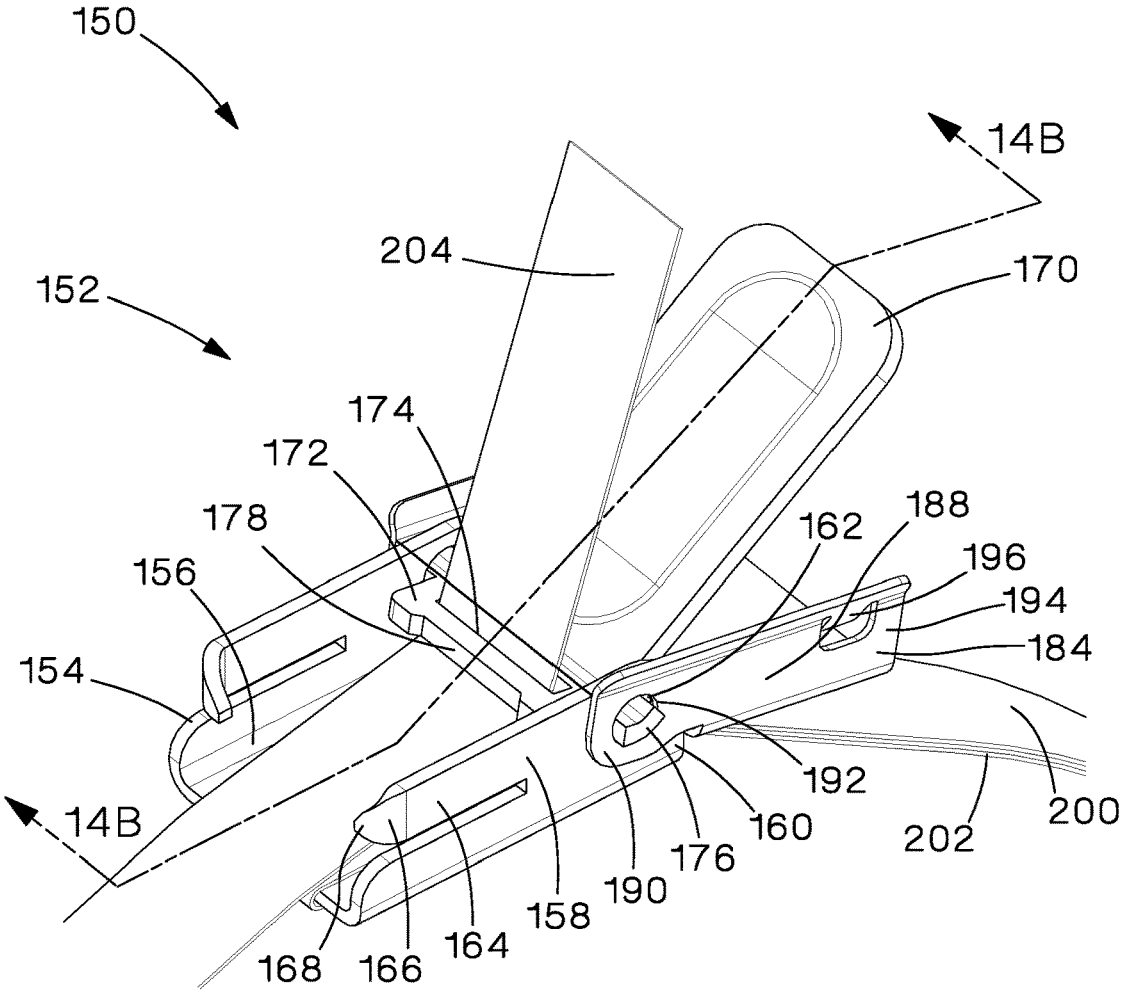
FIG. 14A is a perspective view of the lever tensioner buckle and tie of FIG. 13 with the lever tensioner rotated.
Figure 14B:
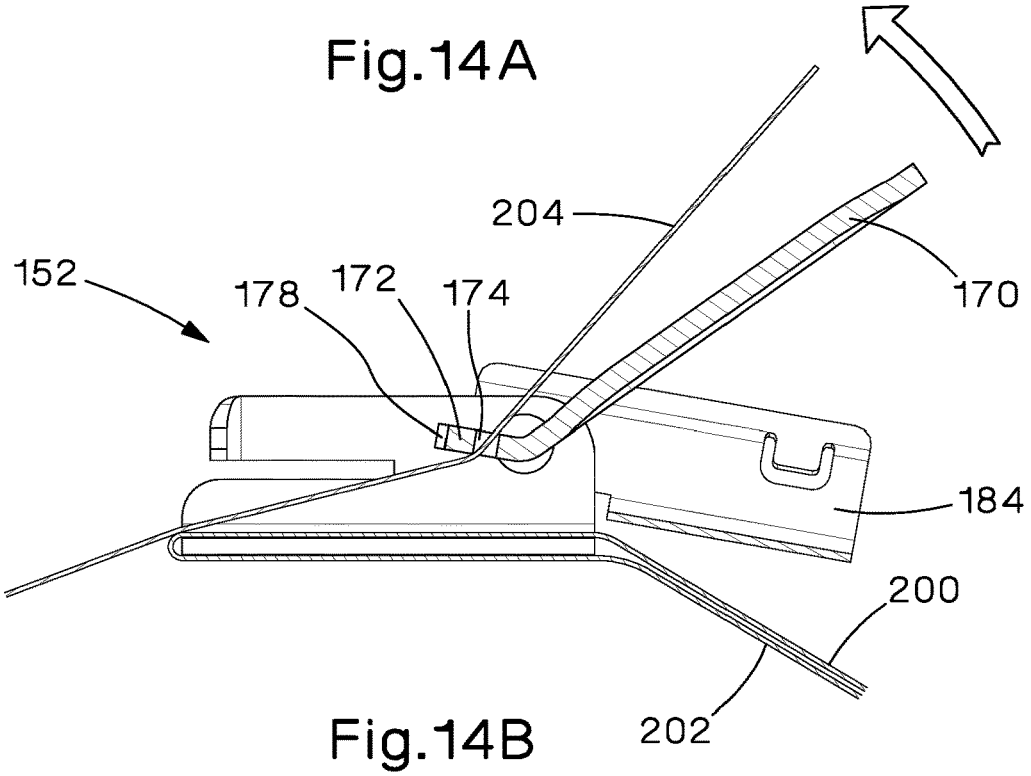
FIG. 14B is a cross-sectional view of the lever tensioner buckle and tie of FIG. 14A taken along line 14B-14B.
Figure 15A:
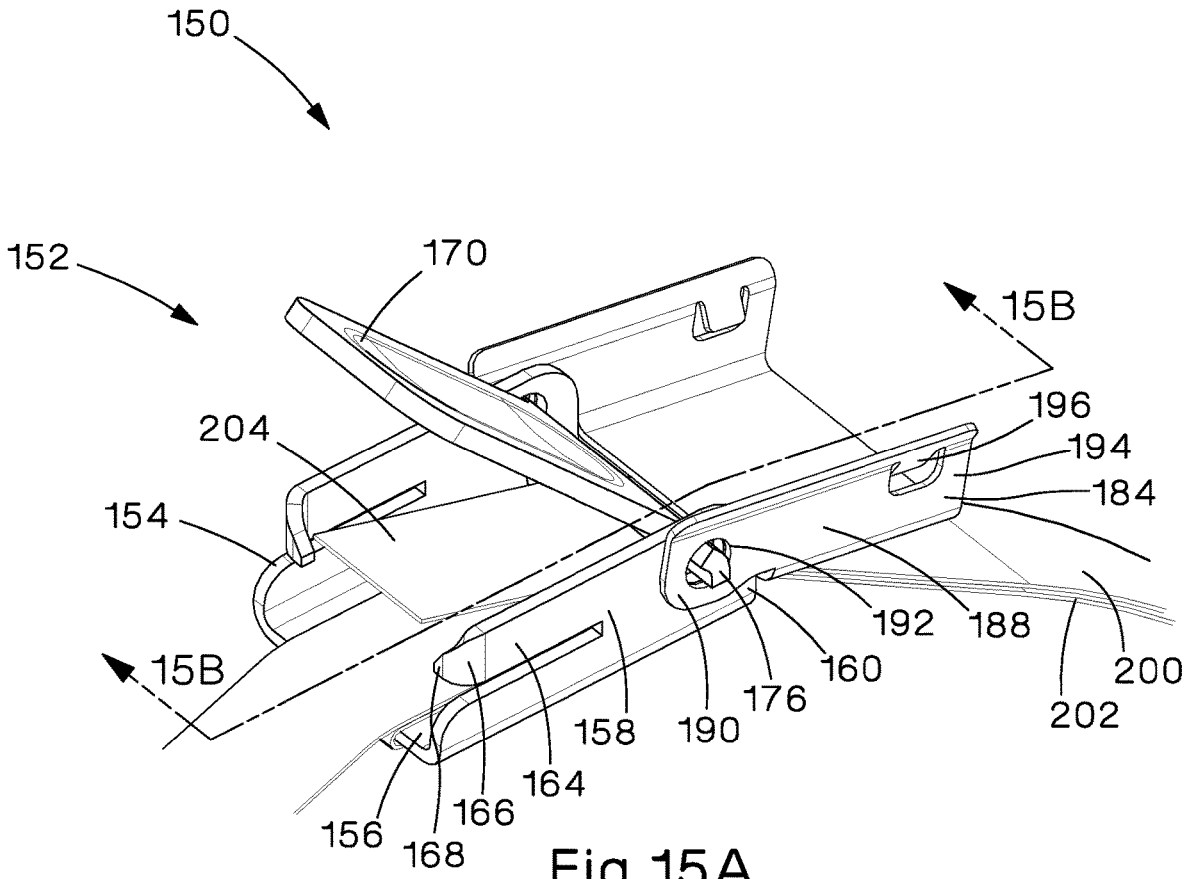
FIG. 15A is a perspective view of the lever tensioner buckle and tie of FIG. 14A with the lever tensioner rotated.
Figure 15B:
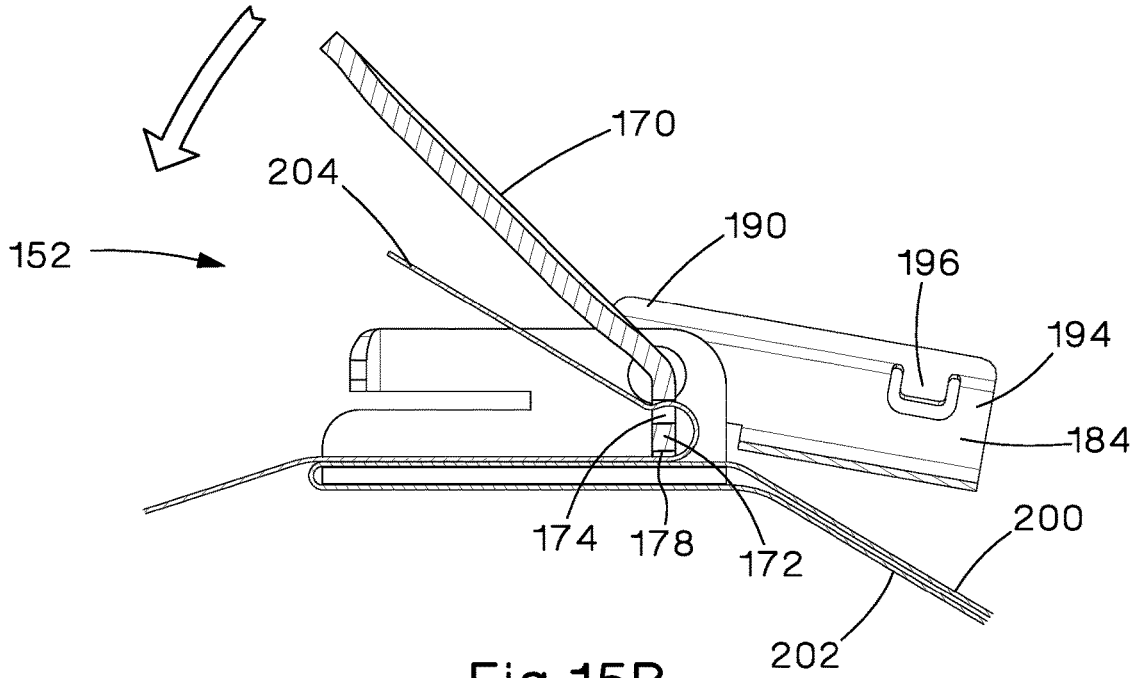
FIG. 15B is a cross-sectional view of the lever tensioner buckle and tie of FIG. 15A taken along line 15B-15B.
Figure 16A:
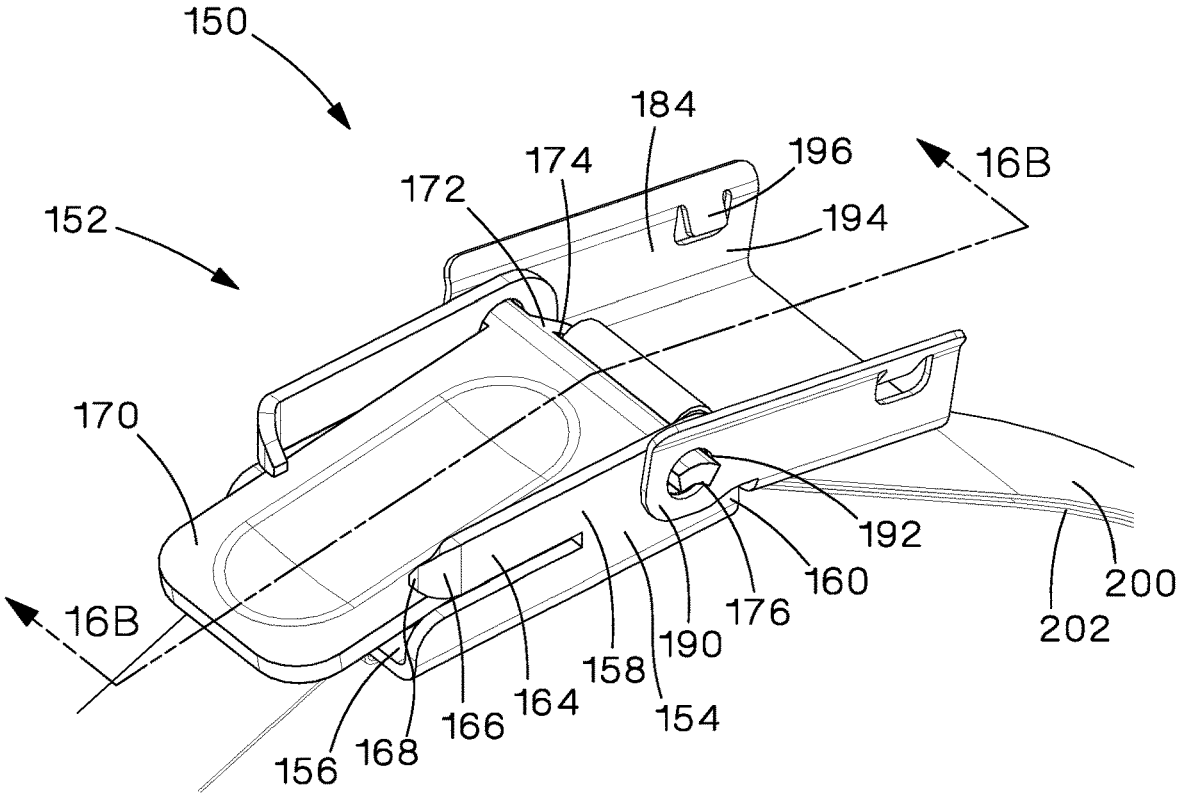
FIG. 16A is a perspective view of the lever tensioner buckle and tie of FIG. 15A with the lever tensioner rotated to the closed position.
Figure 16B:
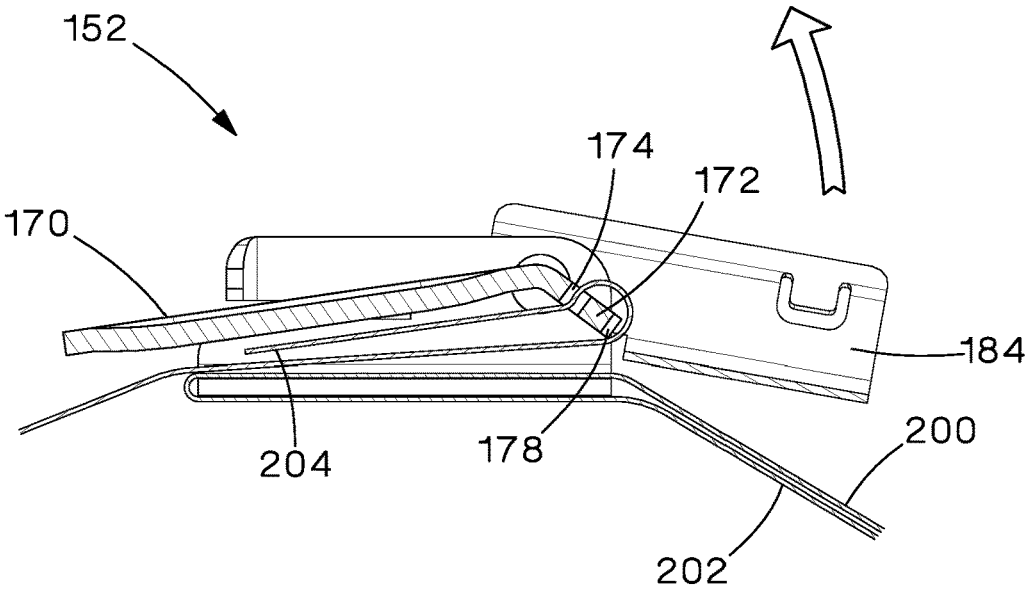
FIG. 16B is a cross-sectional view of the lever tensioner buckle and tie of FIG. 16A taken along the line 16B-16B.

As illustrated in FIG. 10, a folded first end 202 of the tie 200 wraps around the bottom 156 of the buckle base 154. The buckle base 154 and tie 200 are then positioned on a bundle. As illustrated in FIGS. 11 and 12, the tie 200 wraps around to from a loop or circle. When the buckle 152 is fully opened, the second end 204 of the tie 200 is thread thru the elongated slot 174 at the first end 172 of the lever tensioner 170. The tie 200 is then tensioned by hand to make the tie 200 snug on the bundle. If necessary, the second end 204 of the tie 200 is cut leaving about 1-1.5 inches of the tie 200 to extend past the elongated slot 174.

FIGS. 13-16B illustrates the lever tensioner buckle 152 rotating from the open position to a closed position. The elongated slot 174 in the lever tensioner 170 cams the tie 200 as the buckle 152 is closed. The buckle 152 is closed by actuating the lever tensioner 170 until it snaps under the retaining hooks 166 that are at the second end 164 of the buckle base 154. The retaining hooks 166 maintain the lever tensioner 170 in a closed position over the base 154 and tie 200. The lever tensioner 170 can be released, if needed, using a screw driver or pliers. Closing the buckle 152 tensions the tie 200 beyond the initial pre-tensioned amount.

Figure 17A:
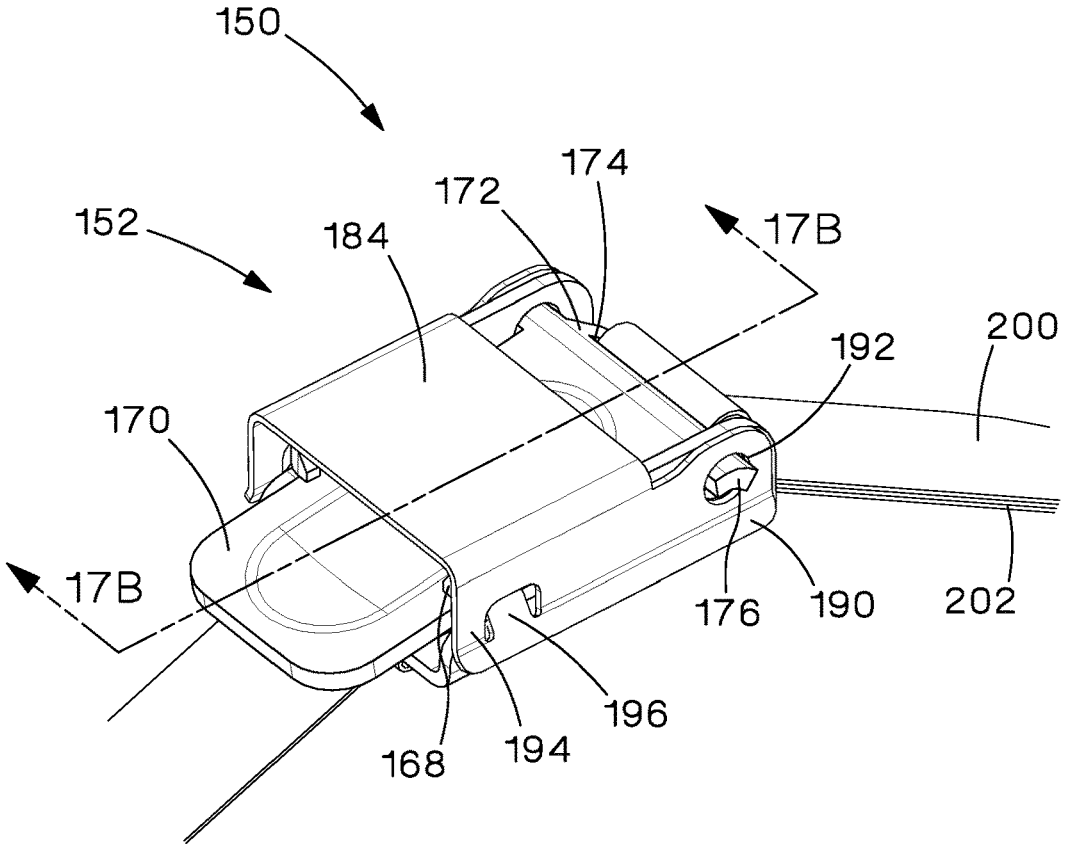
FIG. 17A is a perspective view of the lever tensioner buckle and tie of FIG. 16A with the latching cover rotated to a closed position.
Figure 17B:
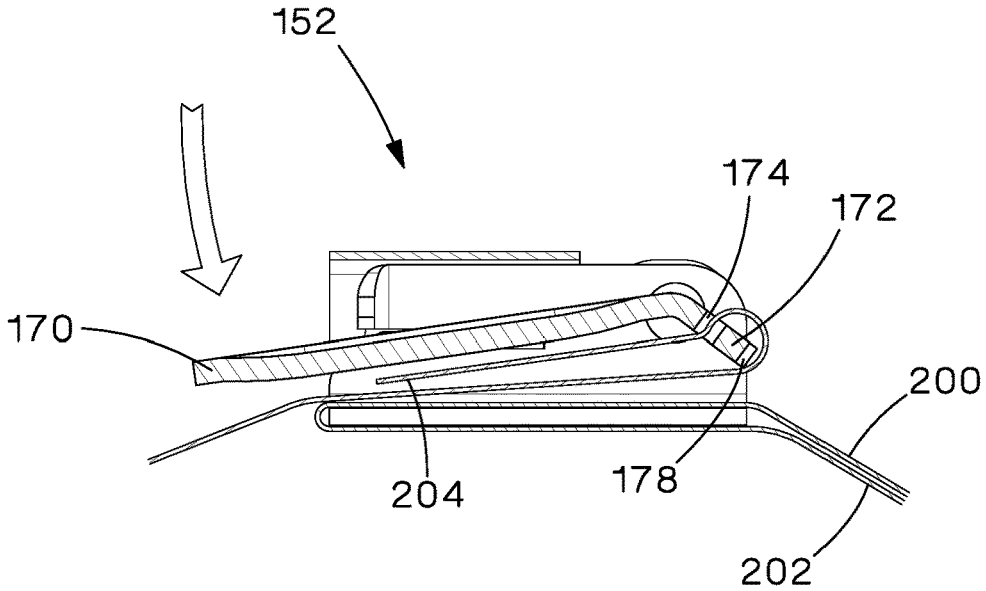
FIG. 17B is a cross-sectional view of the lever tensioner buckle of FIG. 17A taken along line 17B-17B.

FIGS. 17A-17B illustrate the lever tensioner buckle 152 with the cover 184 rotated to a closed position over the tie 200. The cover latches 196 engage the lever tensioner retaining hooks 166 to secure the cover 184 in the closed position. The cover 184 provides additional strength and tamper resistance to the lever tensioner buckle 152. The cover 184 also provides a safety feature by covering the sharp tips 168 of the lever tensioner retaining hooks 166.

The first embodiment 50 and the second embodiment 150 of the lever tensioner buckles 52, 152, respectively, enable a tie to be quickly installed without using a dedicated installation tool. The cam style lever tensioner 70, 170 of the lever tensioner buckle 52, 152, respectively, enables the lever tensioner buckle 52, 152 to retain ties at high tension levels. The lever tensioner buckle 52, 152 retains up to 500 pounds of tension in the stainless steel ties. The lever tensioner buckle 52, 152 is also designed to receive thick gauge stainless steel ties in addition to smaller stainless steel ties.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation.

The invention claimed is:

1. A buckle for fastening opposing ends of an object encircling strap, the buckle comprising:

a base with a bottom and two opposing sides extending from the bottom, each side includes a first end and a second end, wherein the first end includes pivot holes and wherein the second end of the base includes lever tensioner retaining hooks; and a lever tensioner pivotally connected to the base, wherein the lever tensioner includes a first end and a second end, the first end of the lever tensioner has lever pivot hinge tabs adapted to be positioned in the pivot holes of the base to pivotally secure the lever tensioner to the base;

wherein the buckle is closed by actuating the lever tensioner until it snaps under the lever tensioner retaining hooks.

2. The buckle of claim 1, wherein the lever tensioner retaining hooks maintain the lever tensioner in a closed position over the base.

3. The buckle of claim 1, wherein the lever tensioner retaining hooks include inwardly extending tips.

4. The buckle of claim 1, wherein the second end of the lever tensioner includes a slot for receiving a tool to close the buckle.

5. The buckle of claim 1, wherein the first end of the lever tensioner includes an indented portion with a reduced area for receiving a reduced width strap whereby the indented portion prevents smaller straps from sliding on the lever tensioner.

6. A buckle for fastening opposing ends of an object encircling strap, the buckle comprising:

a base with a bottom and two opposing sides extending from the bottom, each side includes a first end and a second end, wherein the first end includes pivot holes;

a lever tensioner pivotally connected to the base, wherein the lever tensioner includes a first end and a second end, the first end of the lever tensioner has lever pivot hinge tabs adapted to be positioned in the pivot holes of the base to pivotally secure the lever tensioner to the base;

wherein the first end of the lever tensioner includes an elongated slot for receiving the strap, wherein the elongated slot cams the strap as the buckle is closed; and wherein the lever tensioner is bent at a pivot point for allowing the strap to be threaded in the elongated slot of the lever tensioner when the buckle is fully open.

7. A buckle for fastening opposing ends of an object encircling strap, the buckle comprising:

a base with a bottom and two opposing sides extending from the bottom, each side includes a first end and a second end, wherein the first end includes pivot holes;

a lever tensioner pivotally connected to the base, wherein the lever tensioner includes a first end and a second end, the first end of the lever tensioner has lever pivot hinge tabs adapted to be positioned in the pivot holes of the base to pivotally secure the lever tensioner to the base; and a cover pivotally connected to the base, wherein the cover includes a top with first and second opposing sides, each side having a first end and a second end, the first end with pivot holes.

8. The buckle of claim 7, wherein the pivot holes in the cover align with pivot holes in the base and the pivot hinge tabs of the lever tensioner.

9. The buckle of claim 7, wherein the second end of the sides of the cover have latches that extend from the sides inwardly towards a center of the cover.

10. The buckle of claim 9, wherein the latches of the cover engage lever tensioner retaining hooks at a second end of the base for securing the cover in a closed position.

* * * * *